US008690386B2

(12) United States Patent
Lee

(10) Patent No.: US 8,690,386 B2
(45) Date of Patent: Apr. 8, 2014

(54) LED BULB

(76) Inventor: Chun-Hsien Lee, Kaohsiung County (TW)

( * ) Notice: Subject to any disclaimer, the term of this patent is extended or adjusted under 35 U.S.C. 154(b) by 581 days.

(21) Appl. No.: 12/761,642

(22) Filed: Apr. 16, 2010

(65) Prior Publication Data

US 2011/0254423 A1 Oct. 20, 2011

(51) Int. Cl.
*F21S 4/00* (2006.01)
*F21V 21/00* (2006.01)

(52) U.S. Cl.
USPC ..... 362/249.02; 362/294; 362/311.02; 362/800

(58) Field of Classification Search
USPC ..... 362/249.02, 294, 311.02, 649–650, 800
See application file for complete search history.

(56) References Cited

U.S. PATENT DOCUMENTS 5,890,794 A * 4/1999 Abtahi et al. ..... 362/294
6,621,222 B1 * 9/2003 Hong ..... 315/51
7,072,115 B2 * 7/2006 Uekita et al. ..... 359/599

* cited by examiner

*Primary Examiner* — Jason Moon Han
(74) *Attorney, Agent, or Firm* — Rosenberg, Klein & Lee

(57) ABSTRACT

An LED bulb comprises a lamp housing, a lamp cap, a core tube disposed inside the lamp housing, a plurality of LED plates mounted on the core tube, and a controller serving to manipulate an on-off operation of the LED plates. Wherein, the controller is substantially disposed inside a room of the core tube, and the core tube has one end thereof connected to the lamp cap, so as to facilitate a free substitution of the controller and promote the using convenience. The connection of the core tube and the lamp cap serves to radiate the thermal created by the LED plates from the core tube toward the lamp cap and the lamp housing for a speedy dissipation and preventing from burning the LED bulb under a high temperature.

3 Claims, 4 Drawing Sheets

LED BULB

BACKGROUND OF THE INVENTION

1. Field of the Invention

The present invention relates to a bulb structure, particularly to an LED bulb with the preferable heat dissipation.

2. Description of the Related Art

FIG. 1 discloses a conventional LED bulb 1. The LED bulb 1 includes a head 11, a base 12 attached to the head 11, a shield 13 disposed above the base 12, a core tube 14 located inside the shield 13, multiple LED plates 15 disposed on the core tube 14, a core base 16 inside the base 12 connected to the core tube 14, and a circuit panel 17 electrically connected to the core base 16. Wherein, the core tube 14 is formed into a hollow configuration by centralizing with respect to an axis. On the core tube 14, a plurality of recesses 141 are defined for an embedment of the LED plates 15. The disposition of the core tube 14 is specialized in lighting; the hollow core tube 14 along with the core base 16 assists in radiating the ensued heat or thermal, therefore the conventional LED bulb 1 substantially obtains effects of illumination and heat dissipation.

In operation, by virtue of the mutual engagement between the core tube 14 and the core base 16 and the location of the core base 16 set within the lamp cap 12, the disposition of the lamp cap 12 overly occupies the space and inevitably reduces the illumination of the LED bulb 1, with the result that the illumination area of the LED plates 15 are affected. Furthermore, although the core base 16 can function as a radiator, the core base 16 wrapped in the lamp cap 12 causes the thermal scattered from the core tube 14 to be unable to dissipate. In this manner, the base 12 may not efficiently cool down if the LED bulb 1 still lasts the lighting and the production of thermal and may become subject to ignition when the circuit panel 17 and the LED plates 15 are over heated under the high temperature, thus still requiring improvements.

SUMMARY OF THE INVENTION

The object of the present invention is to provide an LED bulb that can facilitate a convenient replacement without changing the typical appearance, attain a swift dissipation, and decrease the occurrence of ignition as a result of the over-heated LED bulb.

The present invention essentially comprises a lamp housing, a lamp cap engaged with the lamp housing, a core tube disposed inside the lamp housing, LED plates mounted on the core tube, and a controller controlling an on-off operation of the LED plates; wherein, the controller is arranged in a room of the core tube, which facilitates a direct substitution and allows adapting to the bulb having a typical appearance, thereby increasing the convenience of using. In addition, the core tube has one end thereof connected to the lam cap, so that the thermal produced by the LED plates could be radiated and dissipated through the core tube, the lamp cap, and the lamp housing. In addition to the dissipation, the present invention substantially prevents the ignition of the LED bulb while being subjected to a high temperature.

An LED bulb in accordance with the present invention comprises a lamp housing, a lamp cap engaged with the lamp housing, a core tube disposed inside the lamp housing and providing a room defined at a central thereof, a plurality of LED plates mounted on the core tube, and a controller controlling an on-off operation of the LED plates. Wherein, the controller is arranged within the room, and the core tube has one end thereof connected to the lamp cap, so as to permit a thermal produced by the LED plates to radiate through the core tube, the lamp cap, and the lamp housing.

Preferably, a colloid member is arranged at a connection of the lamp housing and the lamp cap.

Preferably, a plurality of ribs are defined on an outer periphery of the core tube for engaging with and positioning the LED plates.

The advantages of the present invention over the known prior arts will become more apparent to those of ordinary skilled in the art upon reading the following descriptions in junction with the accompanying drawings.

DETAILED DESCRIPTION OF THE PREFERRED EMBODIMENTS

Figure 1:
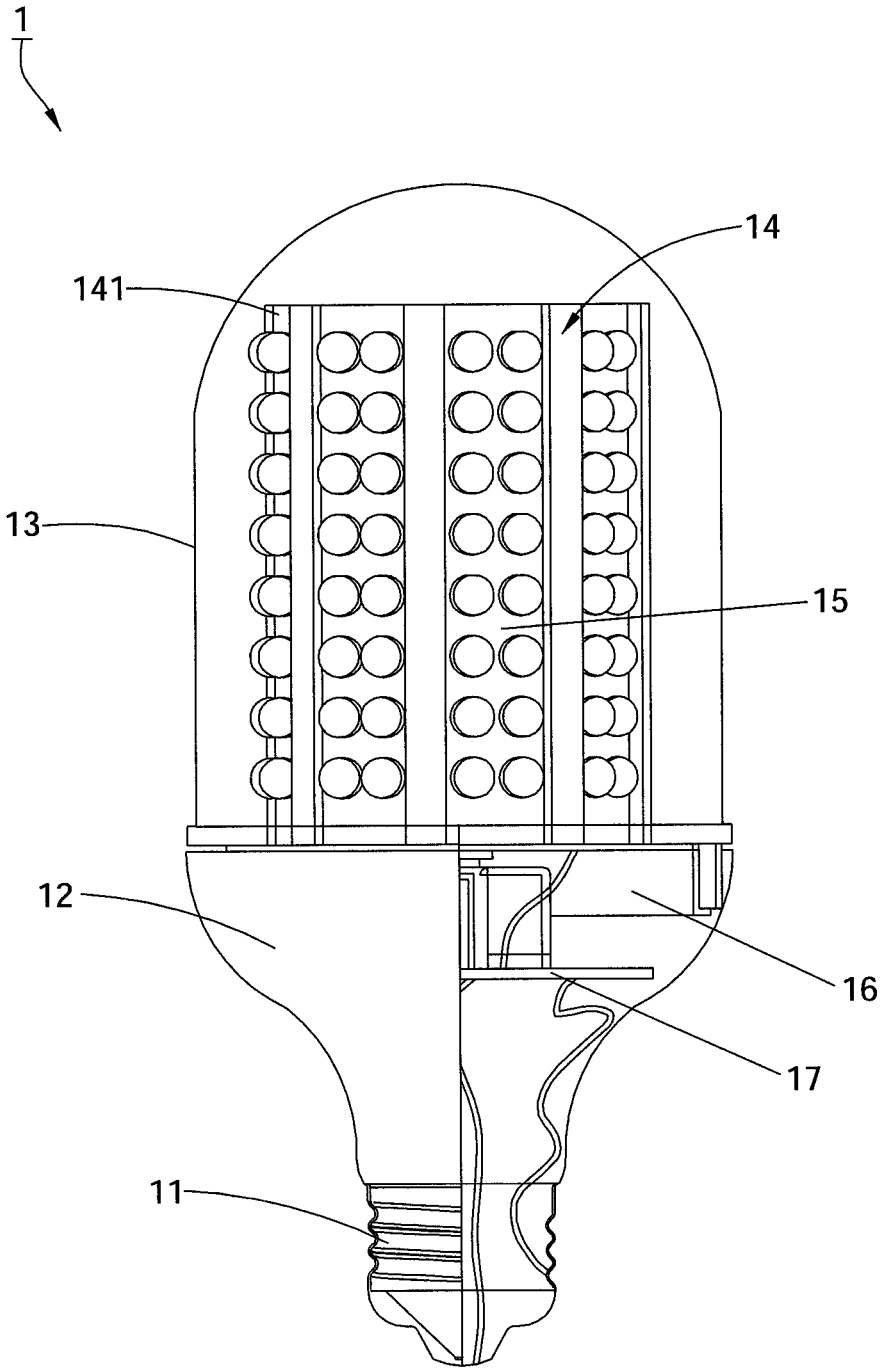
FIG. 1 ( PRIOR ART)
FIG. 1 is a schematic view showing a conventional invention.

Before the present invention is described in greater detail, it should be noted that the like elements are denoted by the same reference numerals throughout the disclosure.

Figure 2:
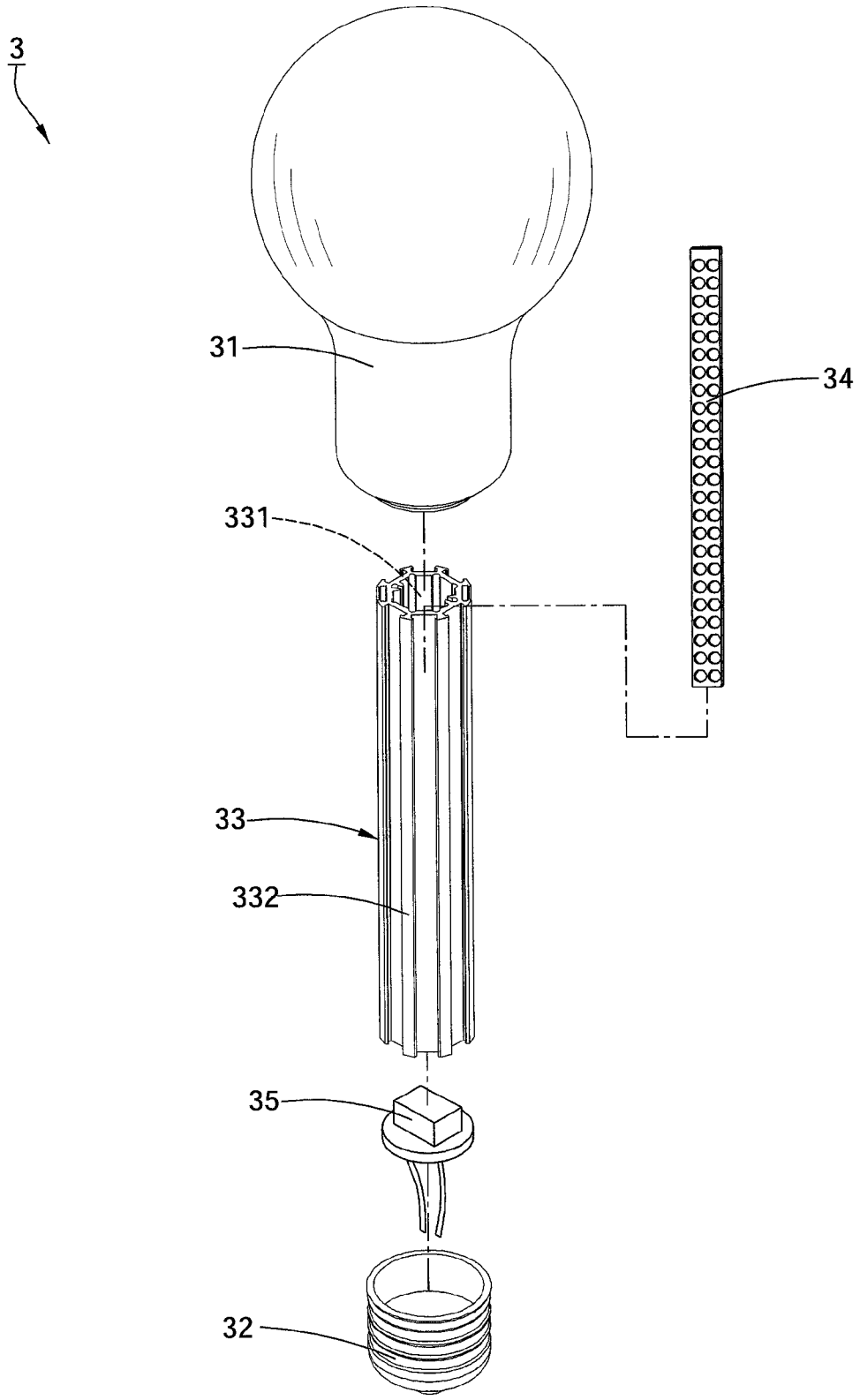
FIG. 2 is an exploded view showing a structure of the present invention.
Figure 3:
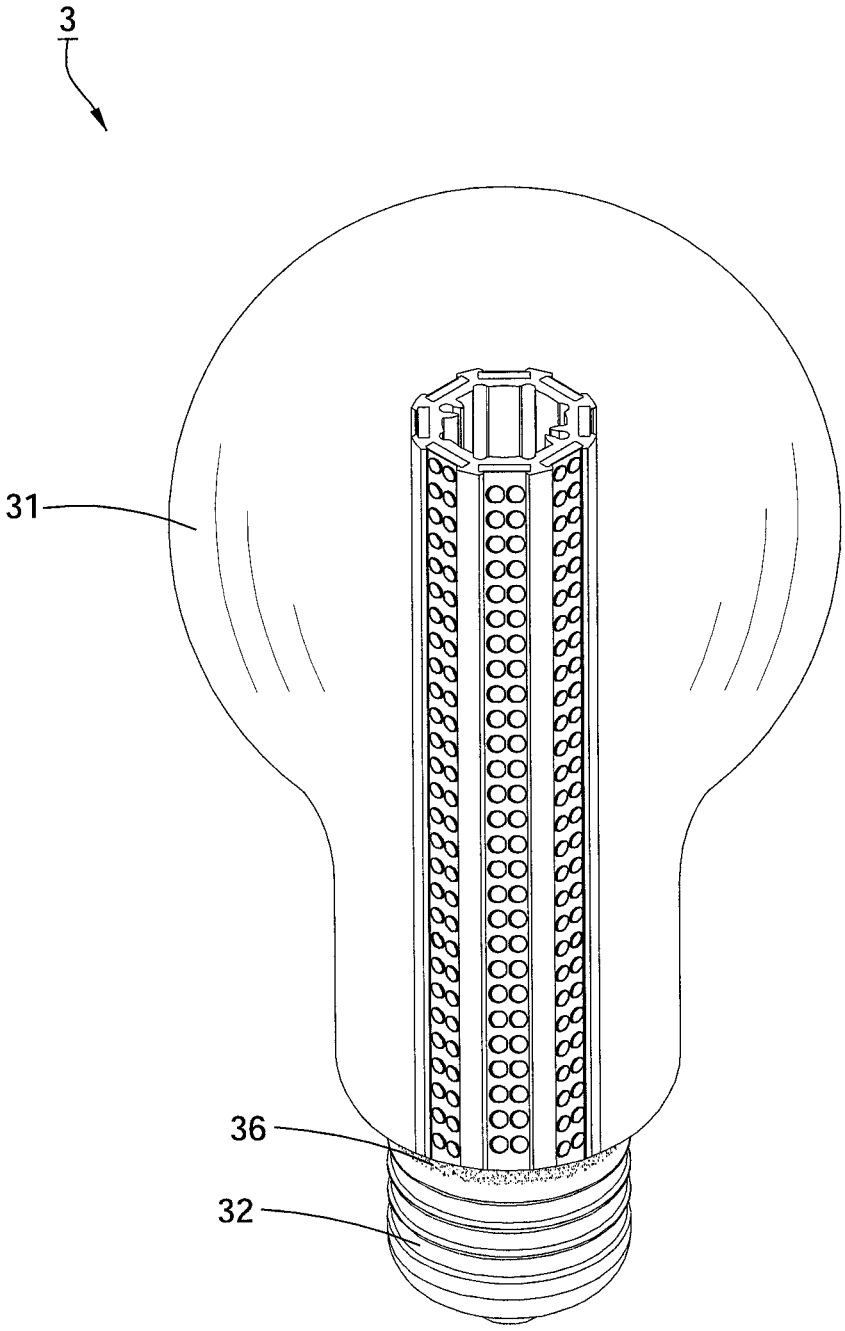
FIG. 3 is a schematic view showing the present invention in assemblage.

FIGS. 2 and 3 show a first preferred embodiment of the present invention. An LED bulb 3 in accordance with the present invention comprises a lamp housing 31, a lamp cap 32 engaged with the lamp housing 31, a core tube 33 disposed inside the lamp housing 31, a plurality of LED plates 34 mounted on the core tube 33, and a controller 35 controlling an on-off operation of the LED plates 34; wherein, the core tube 33 defines a room 331 at a central thereof for accommodating the controller 35. Herein, the core tube 33 can be formed by any feasible contours, for example, an octagonal core tube 33 is performed in the figures. Preferably, there are multiple ribs 332 defining on an outer periphery of the core tube 33 for engaging with and positioning the LED plates 34. Furthermore, the core tube 33 has one end thereof connected to the lamp cap 32, thereby permitting a thermal produced by the LED plates 34 to radiate through the core tube 33, the lamp cap 32, and the lamp housing 31. For promoting a swift dissipating efficiency, a colloid member 36 explicitly shown in FIGS. 3 and 4 is preferably arranged at a joint of the lamp housing 31 and the lamp cap 31.

Figure 4:
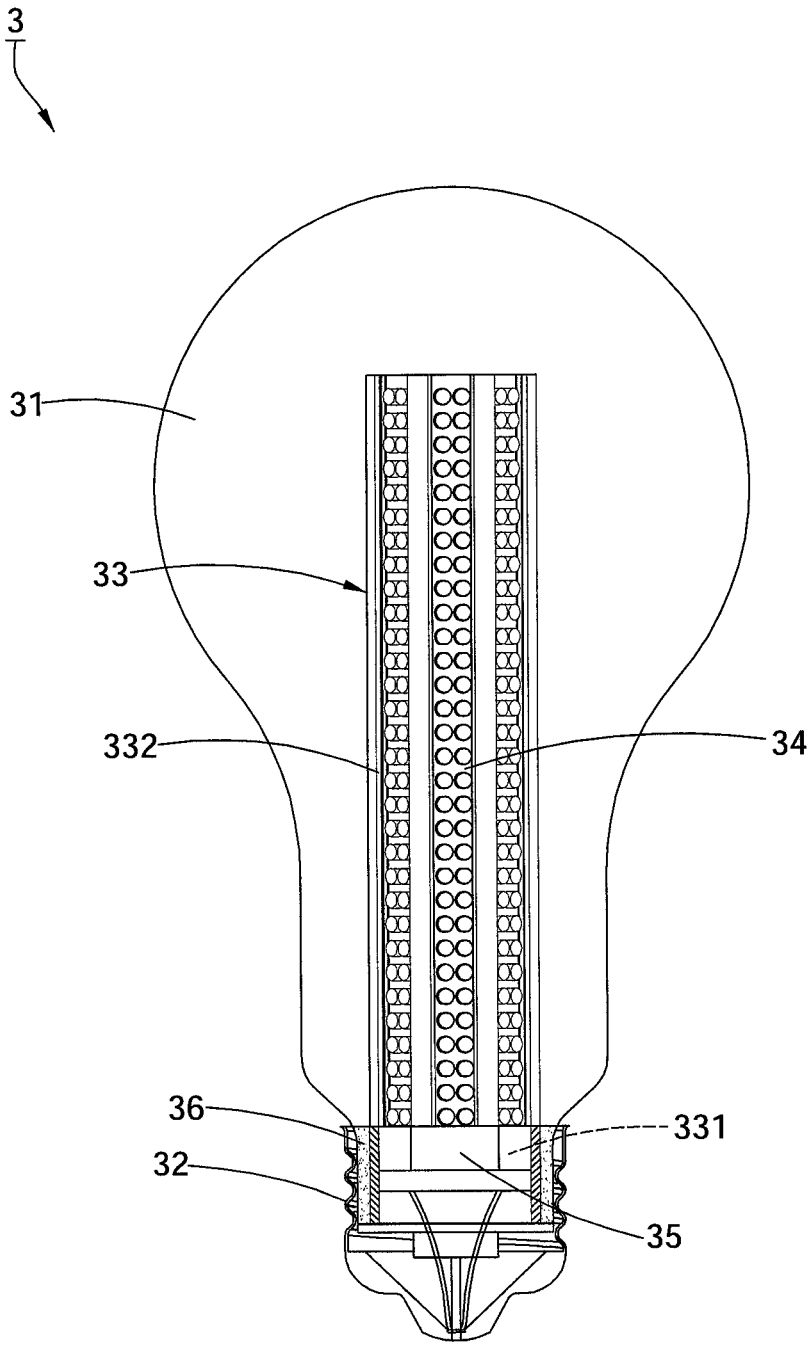
FIG. 4 is a schematic view showing the present invention in operation.

Referring to FIGS. 3 and 4, after assembling the elements as mentioned above, the controller 35 inside the room 331 of the core tube 33 could preferably adapt to a bulb with a typical appearance, like the style of the LED bulb 1 in FIG. 1 and could dispose without occupying large space. The controller 35 mainly serves to switch the illumination of the LED plates 34 and allows a feasible replacement if necessary, so as to increase the using convenience. When in use, the electrified controller 35 activates the LED plates 34 to shine, and concurrently, since the LED plates 34 are disposed on the core tube 33 and the core tube 33 is directly connected to the lamp cap 32, the LED bulb 3 can entirely illuminate without any obstruction, namely to thoroughly perform the brightness of the LED plates 34. In addition, the core tube 33 as defined connects to the lamp cap 32, which renders the lamp cap 32 able to substantially contact with the lamp housing 31. Accordingly, the thermal produced by the LED plates 34 could be dispersed from the core tube 33 and traveled through the lamp cap 32 and the lamp housing 31 for expanding the radiating area, so that the LED plates 34 is kept from burning or igniting incurred by the thermal made by the LED plates 34 abiding in the LED bulb 3 to cause a high-temperature condition. Therefore, the present invention preferably attains the swift heat dissipation.

To sum up, the present invention takes advantage of the controller disposed in the core tube, thereby saving the space, permissibly adapting to a bulb with the typical appearance, and allowing a direct replacement for increasing the convenience of using. The connection of the core tube and the lamp cap further integrally performs and exposing the illumination of the LED plates without covering and leads to the thermal radiating through the lamp cap and the lamp housing, thus providing a favorable dissipation and preventing the overheated LED bulb from burning.

While we have shown and described the embodiment in accordance with the present invention, it should be clear to those skilled in the art that further embodiments may be made without departing from the scope of the present invention.

What is claimed is:

1. An LED bulb having radiant cooling, comprising;

a lamp housing;

a lamp cap engaged with said lamp housing;

a core tube having a first and second end, said core tube defining an inner space in open communication with said first and second ends, said core tube substantially disposed inside said lamp housing;

a plurality of LED plates mounted on an outer periphery of said core tube;

a controller controlling an on-off operation of said LED plates disposed at said first end of said core tube, said controller being disposed to extend within said inner space of said core tube to be encircled by said core tube and said LED plates; and a colloid member is arranged at a connection of said lamp housing and said lamp cap;

wherein said first end of said core tube is coupled to said controller and said lamp cap to define a contiguous medium that thermally dissipates heat produced by said LED plates by radiant cooling of the heat through said core tube, said lamp cap, said inner space and said lamp housing.

2. The LED bulb as claimed in claim 1, wherein a plurality of ribs are defined on the outer periphery of said core tube for engaging with and positioning said LED plates.

3. The LED bulb as claimed in claim 1, wherein said colloid member is disposed to extend annularly about said first end of said core tube.

* * * * *